US005406690A

United States Patent [19]

Neilsen et al.

[11] Patent Number: 5,406,690

[45] Date of Patent: Apr. 18, 1995

[54] DEWIRING APPARATUS FOR BALES

[75] Inventors: Robert F. Neilsen, Birmingham; Peter Hiebert, Helena, both of Ala.

[73] Assignee: Neilsen & Hiebert Systems, Inc., Pelham, Ala.

[21] Appl. No.: 207,371

[22] Filed: Mar. 7, 1994

Related U.S. Application Data

[63] Continuation-in-part of Ser. No. 966,874, Oct. 26, 1992, Pat. No. 5,303,460.

[51] Int. Cl.[6] ..... B23P 19/00

[52] U.S. Cl. ..... 29/564.3; 29/33 F; 29/33.52; 83/909

[58] Field of Search ..... 29/564.3, 563, 33.52, 29/33 F; 83/909

[56] References Cited

U.S. PATENT DOCUMENTS

| | | | |
|---|---|---|---|
| 2,820,282 | 1/1958 | Schneider, Jr. | 83/909 X |
| 3,513,522 | 5/1970 | Thomson | 83/909 X |
| 5,052,098 | 10/1991 | Thumm | 29/564.3 |
| 5,211,525 | 5/1993 | Moltrasio | 83/909 X |

*Primary Examiner*—Z. R. Bilinsky
*Attorney, Agent, or Firm*—Veal & Associates

[57] ABSTRACT

A bale dewiring device uses a bale splitter to sever the strapping of the bale atop the bale and a movable hook to engage the strapping beneath the bale for retraction thereof to one side of the bale where the strapping is removed from the hook.

12 Claims, 4 Drawing Sheets

DEWIRING APPARATUS FOR BALES

This application is a continuation-in-part of application Ser. No. 07/966,874, filed on Oct. 26, 1992 and issued as U.S. Pat. No. 5,303,460 on Apr. 19, 1994.

FIELD OF THE INVENTION

The present invention relates to the field of materials handling and more particularly to the handling of baled material. Still more particularly the invention relates to an apparatus which will remove the strapping from such bales and prevent the entrainment of such strapping with the baled material in subsequent operations on the baled material. In even greater particularity the present invention may be defined as an apparatus for iteratively removing strapping from a plurality of bales which are sequentially processed.

BACKGROUND OF THE INVENTION

The baling of materials is an ancient practice continued in modern times in a variety of industries. Of particular relevance to the instant disclosure are the recycling industries where materials such as paper, cardboard, and other cellulose materials are baled for shipment to a recycling plant where they are debaled and repulped to be reclaimed in another cellulose based end product. Likewise, plastics recycling uses a plurality of post-consumer collection points at which plastic products are baled for shipment to a recycling facility where the bales are broken. Clearly, if the bale strapping materials are not the same as the material in the bales then the strapping would contaminate the baled material if such were not removed prior to recycling. Further, when the strapping is a wire or metal strap, it can do significant damage to the recycling machinery if not removed.

Heretofore, various complex devices have been proposed to remove strapping, however, the only known devices are cumbersome and do not achieve an efficiency satisfactory to meet the standards required for automated recycling of pulp or plastics and have difficulty in dewiring odd sized bales.

SUMMARY OF THE INVENTION

It is the object of the present invention to provide an apparatus to remove strapping from bales of material such that the processing of the material will not result in contamination by the strapping materials.

A further object of the invention is to remove the strapping from the bale without requiring additional handling of the bale.

Yet another object of the invention is to provide an apparatus which can remove strapping regardless of the size of the bale.

These and other objects of my invention are accomplished in a novel combination of elements which capitalize on the nature of the materials used in strapping and the bale material itself. It will be appreciated that most bales are strapped with wire which is more resilient than the fibrous paper or other material contained in the bale. Our invention uses this resilience of the wire to its advantage in securing the wires in a hook which passes subjacent the bale. The hook raises a portion of the bale and hence each wire strap as it passes beneath the bale perpendicular to the strapping. This slightly tensions the strap so that it readily springs into an upwardly opening slot in the hook and remains engaged therein as the hook passes from beneath the bale to a wire stripping area. It is to be understood that the strapping is severed on top of the bale to enable the strapping to be removed in this manner. The hook retracts for use with successive bales.

These and other features and advantages will become more apparent from a perusal of the description of the preferred embodiment in conjunction with the attached drawings.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
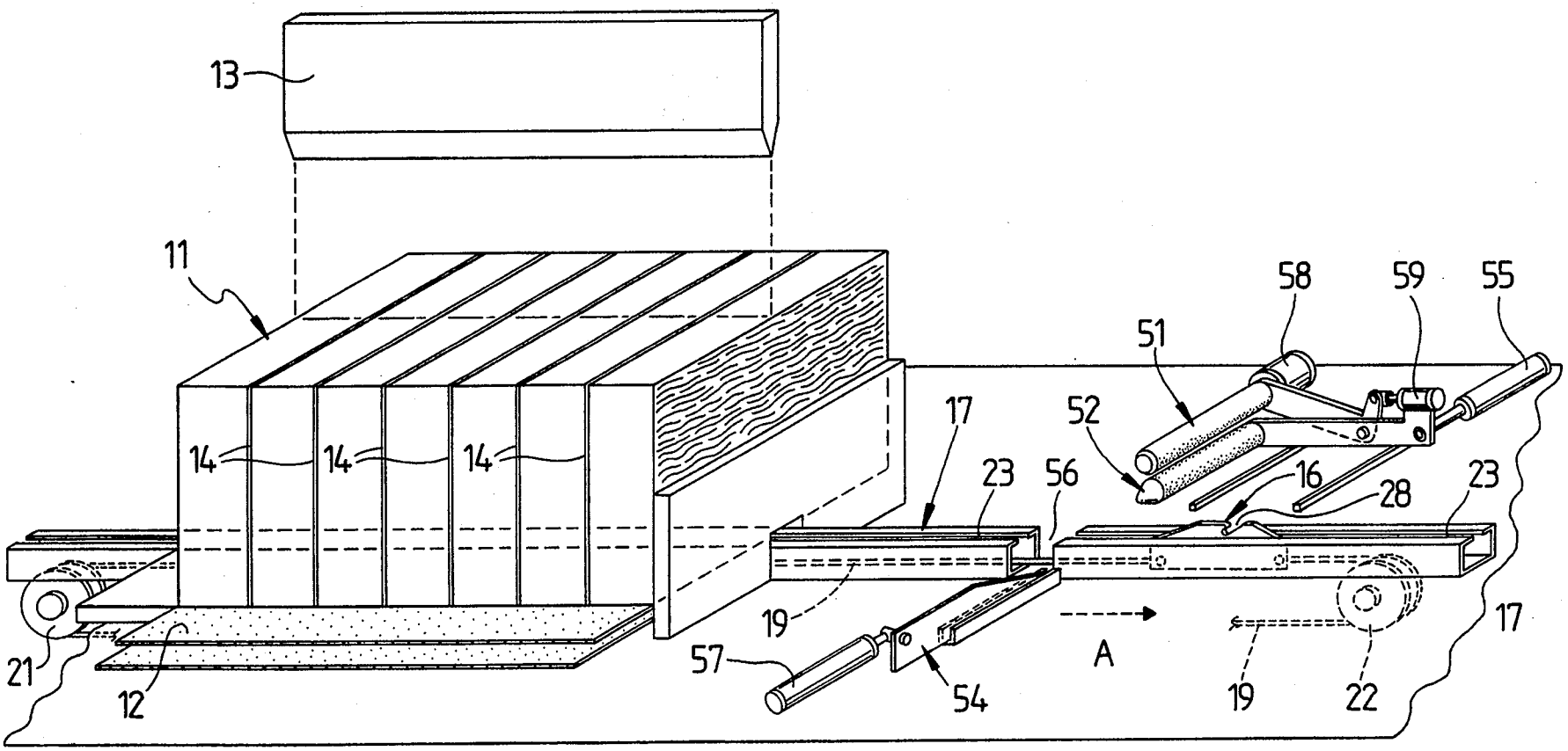
FIG. 1 is a perspective view of the apparatus showing a bale, a conveyor, and a bale splitting blade.

Referring to FIGS. 1–5 for a clearer understanding of the invention it will be noted that a bale 11 of compressed paper or plastic or the like may be pushed across a plate surface by a successive bale or transported as on a moving conveyor 12, of the endless belt type, or other suitable type as is well known in the art, until it reaches a station at which the bale 11 is broken and its contents prepared for further processing. In FIG. 1, the bale 11 is broken by blade 13 which is raised and lowered hydraulically or mechanically, again as is well known in the art; the blade 13 being a component of a bale splitter. As blade 13 descends to near the bottom of the bale 11 it severs the strapping 14, which encircles the bale 11, atop the bale 11, but not beneath the bale 11. The blade 13 may remain in its lowered position proximal the end of the conveyor 12 during the remainder of the dewiring process. The blade may be held in its lowered position to hold the strapping 14 close to the surface of the conveyor or plate so it will be engaged by the hook. Alternatively, the blade 13 may descend only as far as necessary to sever the strapping 14, in which case it would not hold the strapping 14 close to the surface of the conveyor or plate for engagement by the hook.

Figure 3:
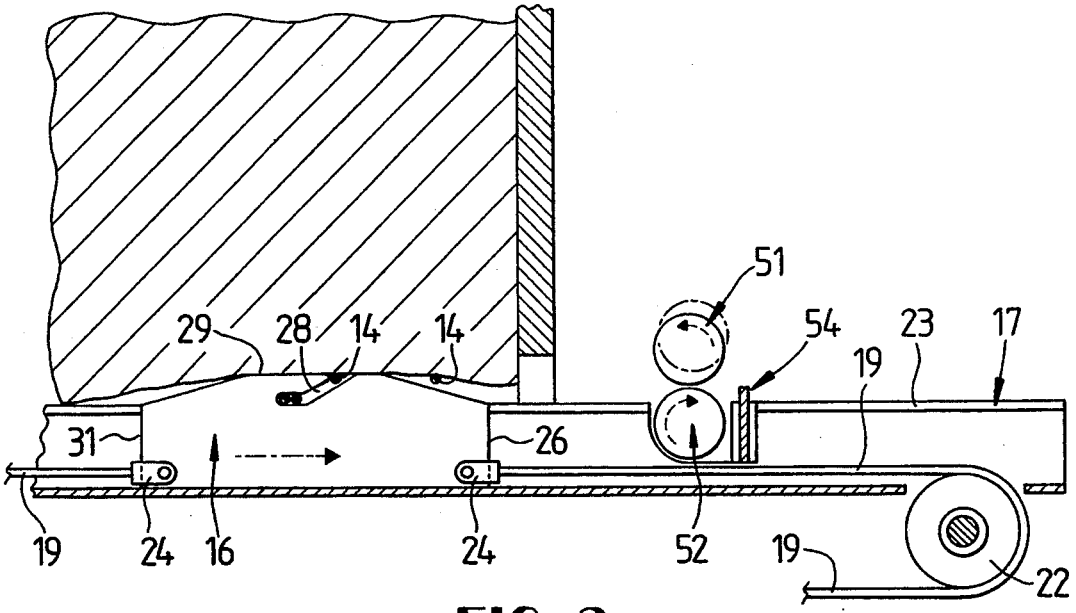
FIG. 3 is a partial sectional view of the hook member beneath a bale.
Figure 4:
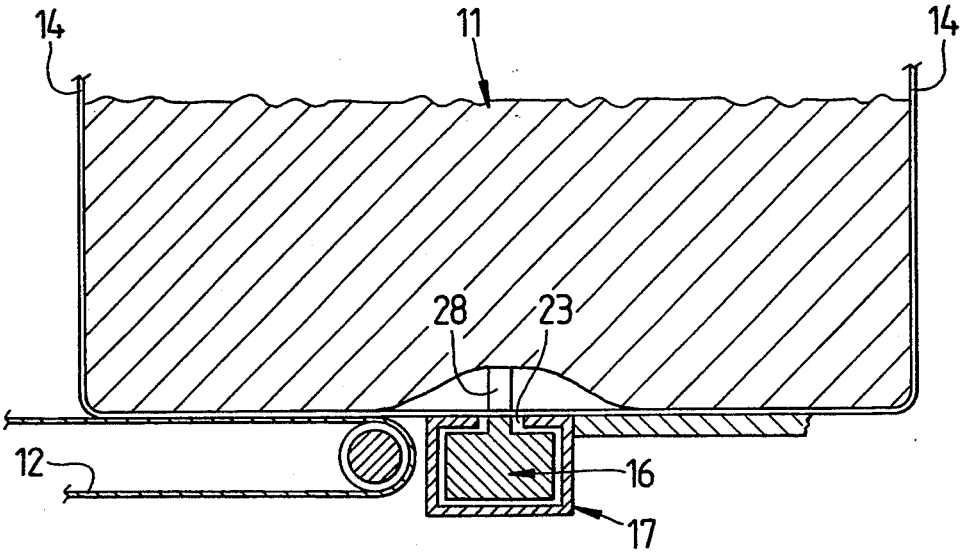
FIG. 4 is a sectional view along line 3—3 of FIG. 2.

To remove the strapping 14 subsequent to its severance by blade 13 we employ a slide member 16, shown more precisely in FIGS. 3 and 4. The slide member 16 is movable transversely of the bale 11 along a channel 17 from one side of the bale 11 to the other and back again. Movement of the slide member 16 is facilitated by a drive motor 18 and chain or cable linkage 19, entrained about a drive pulley 21 and idler pulley 22 at either end of the channel 17. Drive motor 18 is reversible and may be either hydraulically or electrically powered.

Referring to FIGS. 3 and 4 it will be noted that slide member 16 extends longitudinally within channel 17 and upwardly through a slot 23 in channel 17 with linkage 19 attached at each end by connectors 24. Externally of channel 17 the slide member 16 increases in height from a forward end 26 to a point near the middle of the slide member, forming a widened inclined surface 27 extending on both sides of slot 23. Proximal the uppermost portion of surface 27, slide member 16 forms an upwardly opening slot or opening 28 which extends transversely of the slide member 16 and downwardly at an angle away from forward end 26 such that a portion 29 of the slide member overlies the slot 28. Slide member 16 tapers from portion 29 to a rearmost end 31, thus forming an upwardly opening hook at opening 28. Opening 28 is actually defined by surface 32 which extends downwardly and rearwardly from surface 27 and beneath portion 29.

Figure 2:
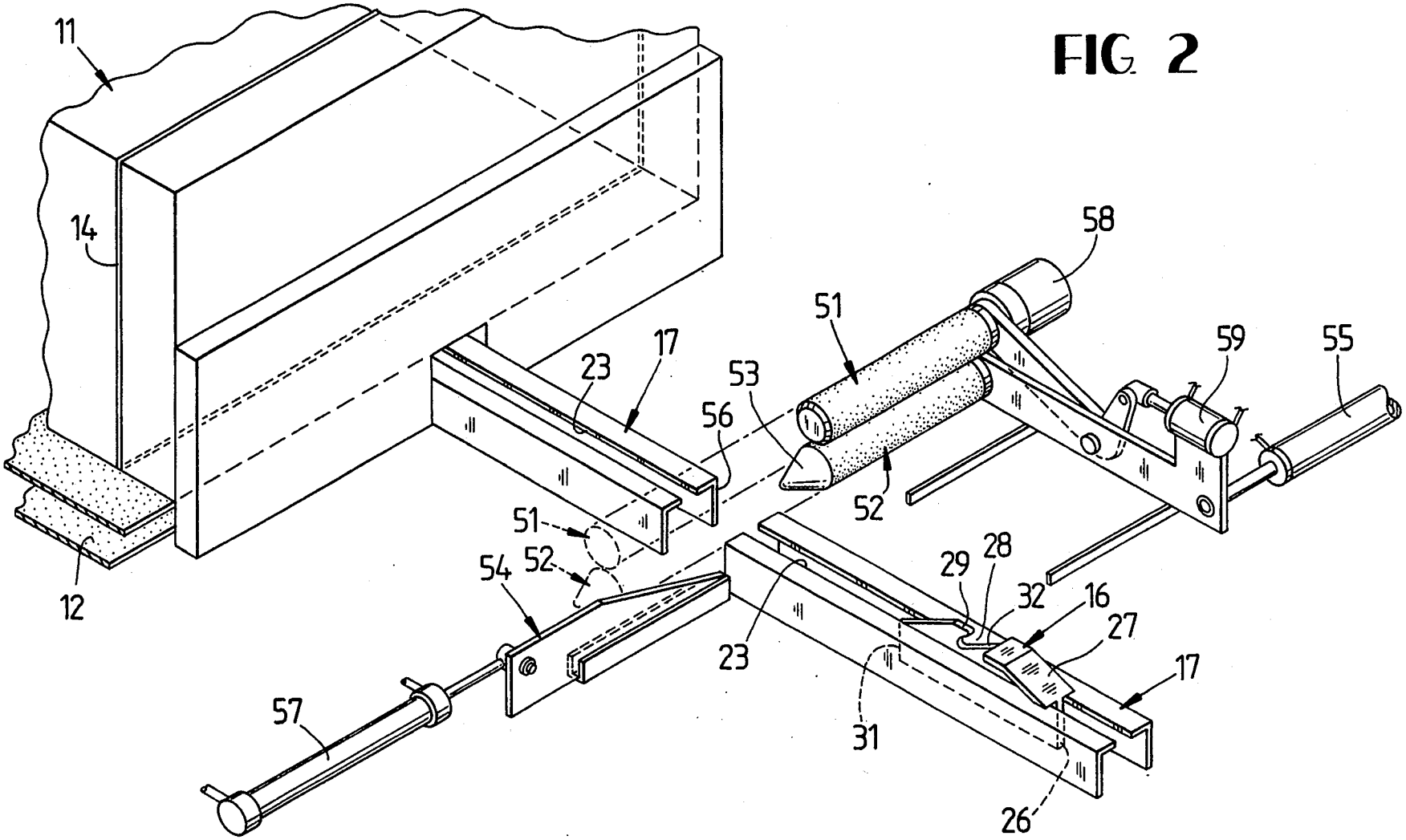
FIG. 2 is an enlarged perspective view of the apparatus.
Figure 5:
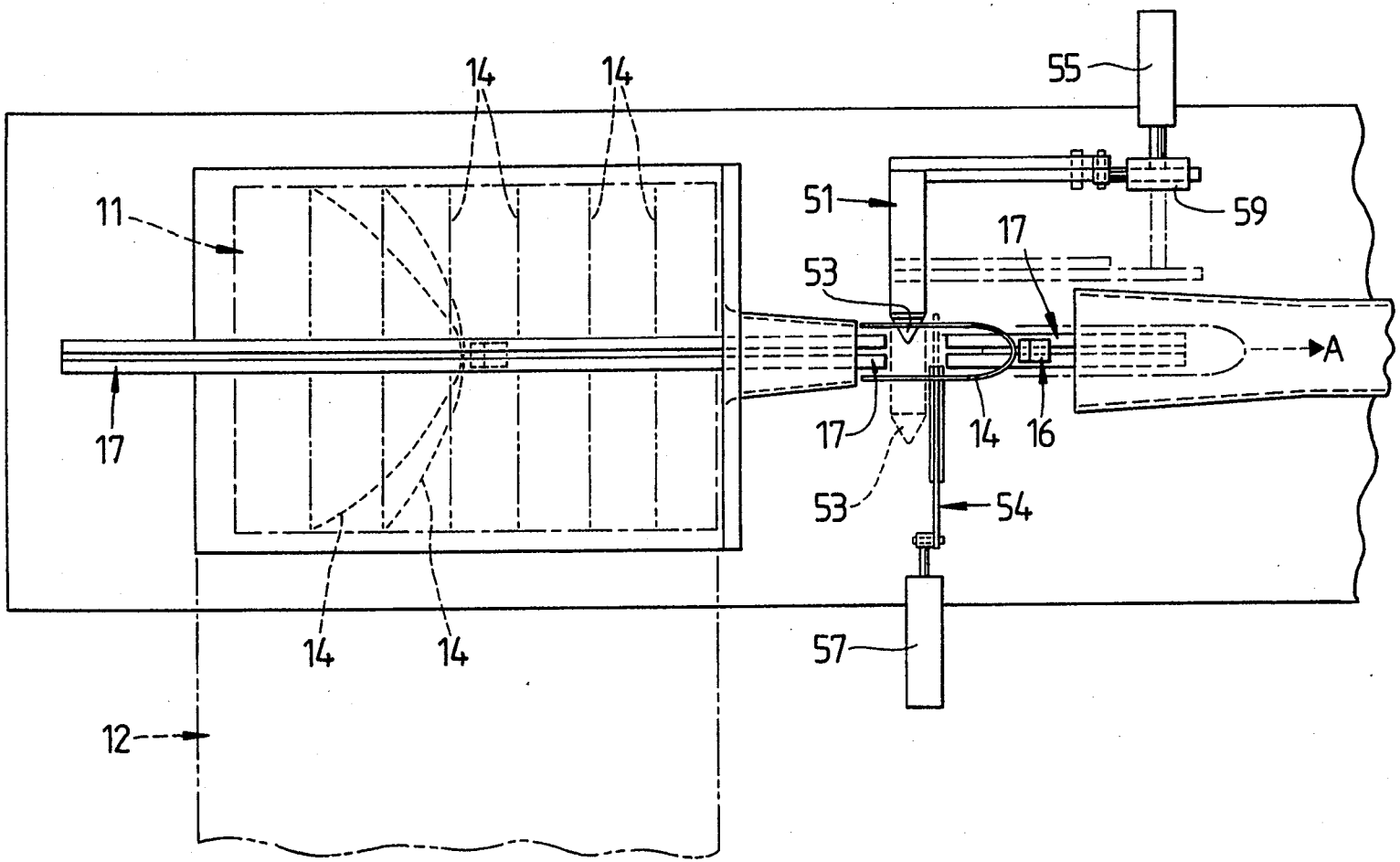
FIG. 5 is a plan view of the apparatus.

As may be appreciated from FIGS. 2 and 3, as slide member 16 moves in the direction of arrow A, the strapping 14 overlying the channel 17 and underlying the bale 11 is lifted along inclined surface 27, thereby tensioning the strapping due to the weight of the bale 11 opposing the camming lifting force of surface 27. Thus, due to the tension or the blade holding wires down, the strapping 14 is readily engaged in slot 28 as it passes beneath the bale and retained therein by the overlying portion 29. Surface 27 serves not only to cam strapping 14 upwardly, but also serves as a guard to reduce entrainment of bale material in the slot 28 by guiding the less resilient bale material upwardly over the portion 29. Of course, the bale material is generally of a size to minimize entry into slot 28. It is noteworthy to mention that slot 28 is appropriately sized to receive a plurality of wire strapping members as slide member 16 passes beneath the bale 11, carrying all of them outwardly beyond the bale as indicated in FIGS. 1 and 5. As illustrated in FIG. 5, the strapping 14 trails behind slide member 16 in a somewhat U-shaped trail which is made more pronounced and defined by a housing 36. Housing 36 is intended to guide the trailing strapping into a well-defined locus behind the slide member 16 as it passes through opening 37 in housing 36.

One means of stripping the strapping from slide member 16 is illustrated in FIGS. 1, 4 and 5. Located outwardly of the housing 36 are a set of cylindrically-shaped rollers including an upper roller 51 and a lower roller 52. The rollers are initially positioned outside of and perpendicular to channel 17. Lower roller 52 terminates in a cone-shaped tip 53. On the side of channel 17 opposite the rollers is a wedge-shaped cam plate 54, also perpendicular to and positioned initially exterior to channel 17. A break 56 is defined in channel 17 between the set of rollers 51 and 52 and the cam plate 54. The break 56 is of sufficient width to accommodate both the set of rollers 51 and 52 and the cam plate 54. Cam plate 54 is movable horizontally, via a mechanism such as a gear or linear actuator 57, to raise the trailing strapping 14 behind the slide member 16 to a height between the initial levels of the upper roller 51 and the lower roller 52. Rollers 51 and 52 are movable both along the horizontal axis perpendicular to the channel 17 and along a vertical axis, and each roller rotates about its longitudinal axis. The rollers 51 and 52 are actuated horizontally by a hydraulically-powered gear or linear actuator 55, vertically by a hydraulic piston 59 and rotationally by a hydraulically or electrically powered drive motor 58. When slide member 16 reaches its forwardmost position, cam plate 54 moves through the break 56 in channel 17, raising the strapping 14 along the inclined edge 57 of the cam plate 54. Rollers 51 and 52 move through the break 56 in channel 17 on the side of the cam plate 54 opposite the slide member 16, with upper roller 51 positioned above the strapping 14, and lower roller 52 positioned below the strapping 14. The cone-shaped tip 53 of the lower roller 52 works in cooperation with the cam plate 54 to raise the strapping 14 to the proper level between the rollers 51 and 52. Rollers 51 and 52 move into contact with each other, thereby grasping the strapping 14. The rollers rotate in a direction to urge the strapping up surface 32, out of engagement with the slide member 16 and into a chute 46 for disposal in a chopper or other means. Upon the return of rollers 51 and 52 and cam plate 54 to their original positions, slide member 16 may be retracted, free of the strapping 14, to its starting position to await the next bale. The actuation of the rollers 51 and 52, cam plate 54 and motor 18 may be controlled by appropriately placed limit switches as is well known in the art.

While I have shown my invention in one form, it will be obvious to those skilled in the art that it is not so limited but is susceptible of various changes and modifications without departing from the spirit thereof.

What we claim is:

1. An apparatus for removing strapping from bales which have been moved longitudinally along a conveyor to a terminal end thereof, comprising in combination:

(a) means located proximal a terminal end of said conveyor for severing a bale from the top of said bale toward the bottom such that said strapping is severed atop said bale;

(b) a slide member mounted for powered movement subjacent said bale transversely of said conveyor and having an upwardly opening slot formed therein, said slot extending transversely of said conveyor toward an end of said slide member such that said strapping is entrained within said slot as said slide member moves transversely of said bale;

(c) means for confining said strapping behind said slide member as said slide member moves outwardly from beneath said bale;

(d) means located laterally of said conveyor for grasping said strapping and disengaging said strapping from said slot in said slide member; and (e) means located laterally of said conveyor for raising said strapping behind said slide member such that said strapping is in proper position for engagement by said grasping and disengaging means.

2. An apparatus as defined in claim 1, wherein said confining means comprises:

(a) a vertically extending wall adjacent one side of said conveyor having an aperture therethrough adapted for passage of said slide member therethrough such that said strapping carried by said slide member is deformed to an acute angle about said slide member as said strapping is urged through said aperture;

(b) a channel, having a first end adjacent said vertical wall, said channel further extending laterally from said conveyor to a second end, said channel being of a size to restrict outward flexure of said strapping from said slide member.

3. An apparatus as defined in claim 1, wherein said grasping and disengaging means comprises:

(a) a cylindrically-shaped upper roller, positioned horizontally and substantially perpendicular to the direction of movement of said slide member;

(b) a cylindrically-shaped lower roller, in parallel alignment with and below said upper roller, said lower roller having a cone-shaped tip on an end proximal said means for confining;

(c) means for moving said upper roller and said lower roller horizontally and substantially transversely of said entrained strapping;

(d) means for urging said upper roller and said lower roller into concomitant engagement with said entrained strapping; and (e) means for rotating said upper roller and said lower roller in a direction to urge said strapping forward and out of engagement with said slot in said slide member.

4. An apparatus as defined in claim 3, wherein said horizontal moving means comprises a linear actuator.

5. An apparatus as defined in claim 4, wherein said vertical moving means comprises a linear actuator operatively connected to move one of said upper rollers vertically relative to said entrained strapping.

6. An apparatus as defined in claim 5, wherein said rotating means comprises a hydraulically-powered drive motor operatively connected to at least one of said rollers.

7. An apparatus as defined in claim 5, wherein said rotating means comprises an electrically-powered drive motor.

8. An apparatus as defined in claim 6, wherein said means for raising said strapping comprises:

(a) a wedge-shaped cam plate, positioned substantially perpendicular to said entrained strapping and on the side of said entrained strapping opposite from said upper and lower rollers; and (b) means for moving said cam plate horizontally beneath said entrained strapping, such that said cam plate is positioned between said rollers and said slide member and such that said strapping rests on an upper edge of said cam plate.

9. An apparatus as defined in claim 8, wherein said cam plate moving means comprises a linear actuator.

10. An apparatus as defined in claim 3, wherein said means for raising said strapping comprises:

(a) a wedge-shaped cam plate, positioned substantially perpendicular to said entrained strapping and on the side of said entrained strapping from said upper and lower rollers; and (b) means for moving said cam plate horizontally beneath said entrained strapping, such that said cam plate is positioned between said rollers and said slide member and such that said strapping rests on an upper edge of said cam plate.

11. An apparatus as defined in claim 10, wherein said cam plate moving means comprises a linear actuator.

12. An apparatus for removing entrained elongated semirigid straps from an entraining hook having an upwardly and forwardly opening slot comprising:

(a) a wedge-shaped cam plate, positioned substantially perpendicular to and laterally of said entrained strapping;

(b) means for moving said cam plate horizontally beneath said entrained strapping, such that said strapping rests on an upper edge of said cam plate;

(c) means, positioned on the side of said entrained strapping opposite from said cam plate, for engaging said straps and urging said straps forwardly of said hook.

* * * * *